US006070603A

United States Patent [19]

Politz

[11] Patent Number: 6,070,603

[45] Date of Patent: Jun. 6, 2000

[54] WALKER FOR PERSONS HAVING USE OF ONLY ONE ARM

[76] Inventor: Janice A. Politz, 760 Indian Beach La., Sarasota, Fla. 34234

[21] Appl. No.: 09/131,220

[22] Filed: Aug. 7, 1998

[51] Int. Cl.[7] ..... A45B 3/00

[52] U.S. Cl. ..... 135/67; 135/65; 280/304.1; 482/68

[58] Field of Search ..... 135/65, 67, 74; 280/42, 87.021, 87.05, 250.1, 287, 304.1; 297/5; 482/68

[56] References Cited

U.S. PATENT DOCUMENTS

| | | | |
|---|---|---|---|
| 4,708,357 | 11/1987 | Soderbaum | 280/304.1 X |
| 4,852,697 | 8/1989 | Kulik | 280/304.1 X |
| 4,907,794 | 3/1990 | Rose | 135/67 X |
| 4,962,781 | 10/1990 | Kanbar | 135/74 X |
| 5,020,560 | 6/1991 | Turbeville | 135/67 |
| 5,172,715 | 12/1992 | Webb | 135/67 |
| 5,322,312 | 6/1994 | Cammack | 280/304.1 X |
| 5,409,028 | 4/1995 | Lee | 135/67 X |
| 5,647,602 | 7/1997 | Nevin | 135/67 X |

*Primary Examiner*—Richard Chilcot
*Attorney, Agent, or Firm*—Frank A. Lukasik

[57] ABSTRACT

An improvement to a standard three-wheeled walker to render it usable by persons having the use of only one arm for support, moving, and braking the walker is provided. The braking system for use on two of the three wheels includes a crossbar having a brake handle mounted thereon and a section of brake wire having one end connected to the brake handle. The other end of the brake wire is connected to a bifurcated "Y" brake wire connector, the ends of which are adapted to apply pressure to the tires of the respective wheels while the user still maintains control of the walker.

7 Claims, 2 Drawing Sheets

WALKER FOR PERSONS HAVING USE OF ONLY ONE ARM

BACKGROUND OF THE INVENTION

1. Field of the Invention

This invention relates to walking aids and, more particularly, to a walker equipped with wheels and a braking system operable by only one arm of the user. The braking system includes an arm above each rear wheel that is forced downward into contact with the wheel, and a foot, pad on the upper side of each arm for applying foot pressure to brake each wheel individually as desired.

2. Description of the Prior Art

Of the many types of walkers available today, all require the use of two arms of the user to control both stability of the person and forward movement, of the walker. Many of the existing walkers are so bulky and heavy as to be not suitable for control by one arm of the user, and in the event a walker may be manipulated by one arm, conventional walkers definitely cannot be braked by only one arm of its user. These limitations render conventional walkers unusable by, for example, victims of a stroke who have only one arm to support them and to move the walker. Such walkers, of course, are also unusable for persons born with physical defects of mobility as well as for those victims of accidents or war injuries who have lost an entire limb. A further complication arises when it becomes necessary for such persons to brake their walker during use thereof.

U.S. Pat. No. 5,020,560 to Turbeville concerns a three-wheeled walker having braking means associated with its two rear wheels, the braking means being operable on each wheel individually by applying arm pressure on respective left and right arm respective wheels of the walker.

U.S. Pat. No. 5,172,715 to Webb relates to a foldable four-wheel walker that has individual braking means for the rear wheels thereof which means are operable by right and left hand brake levers that cause brake pads to apply pressure to opposite sides of the respective wheels. Compression can be made constant by simply maintaining hand pressure on the respective brake lever.

U.S. Pat. No. 5,431,255 to Tsuchie concerns a braking device for bicycles having a two-wire braking system wherein a common relay wire causes actuation of both front and rear brakes when compression is applied to either one of the handlebar brake levers.

It can readily be appreciated that these references, either singly or in combination, are not, concerned with and do not suggest or infer the method and apparatus of the present invention for braking a three-wheeled walker or similar device by persons having the use of only one arm for moving and braking the walker.

SUMMARY OF THE INVENTION

Accordingly, it is an object of this invention to provide a braking system for three-wheeled or other walkers that is operable by persons having the use of only one arm for support, moving and braking the walker.

It is another object of this invention to provide such a system for standard walkers having two handles by placing a crossbar therebetween and installing a single brake handle centrally in the crossbar.

It is a still further object of the invention to provide a braking system for four- or three-wheeled walkers in which pressure by one arm of a user on a crossbar provides support for the user while pressure on a brake handle centrally positioned on the crossbar provides braking pressure by applying a braking force to the walker's rear wheels.

It is another object of this invention to provide such a system in which a braking force is initiated by one arm of the user and is applied to the upper outer surface of the tires on the walker's rear wheels.

It is yet another object of this invention to provide such a system in which the braking force may be applied by foot to alternate ones of pads disposed over each of the walker's rear wheels.

The foregoing objects are realized in the present invention by providing a braking system for walkers on wheels that may be adapted for use by persons having the use of only one arm. The braking system includes replacing the walker's normal braking means with a crossbar connected between the two handle bars of the walker and installing a single brake handle centrally in the crossbar. A "Y" connector is secured centrally in the walker to relay a braking force to each of the rear wheels thereof, the braking force preferably being applied to the upper surface of the wheel tires by spring-loaded pads which are forced downward into contact, therewith. This positioning of the pads permits foot pressure to be applied to alternate ones of them by the user.

BRIEF DESCRIPTION OF THE DRAWINGS

The foregoing and further objects of the invention will become apparent from reading the following detailed description of preferred embodiments of the invention, in which.

DETAILED DESCRIPTION OF THE INVENTION

Figure 1:
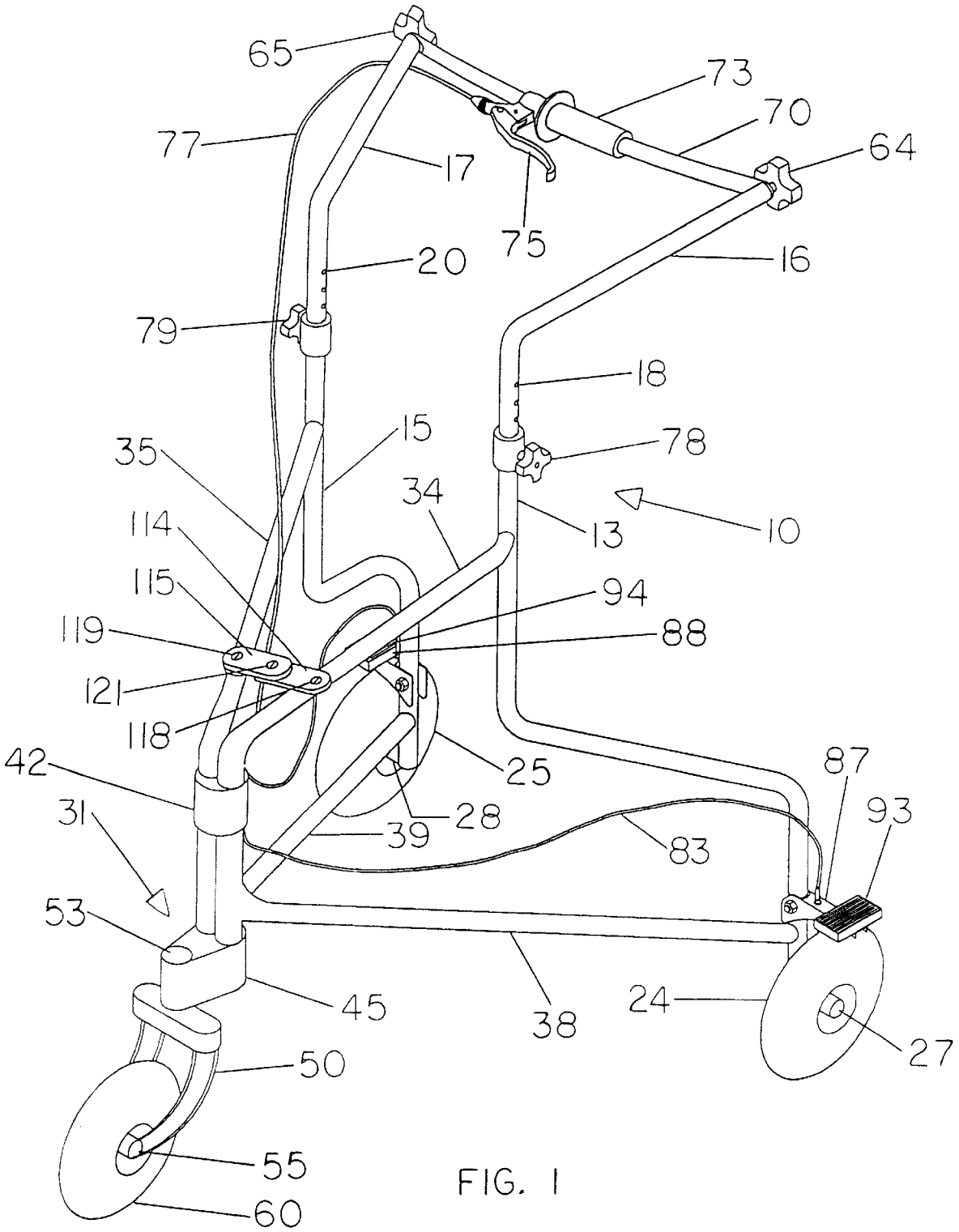
FIG. 1 is a perspective view of the invention.

Turning now to the drawings, more particularly to FIG. 1, there is shown a three-wheeled walker 10 which comprises a lower section having a pair of similarly formed lower support members 13 and 15 that are received into an tipper section having a pair of upper support members 16 and 17 in sleeve portions thereof 18 and 20. Members 13 and 15 are connected to a pair of rear wheels 24 and 25 by axles 27 and 28 and to a front wheel assembly 31 by upper forwardly extending members 34 and 35 and lower forwardly extending members 38 and 39. Members 34,35 and 38,39 are joined together in a collar 42 and terminate in a junction box 45. A forked wheel support 50 is rotatably received in box 45 as indicated at 53 while the forked ends of support 50 are connected to an axle 55 about which a wheel 60 rotates.

The ends of upper members 16 and 17 are threaded to receive winged bolts 64 and 65 which are used to secure in place a crossbar 70 whose ends are flanged and drilled in conventional manner to receive bolts 64 and 65. Crossbar 70 has a centrally disposed grip 73 that includes a handle 75 connected to a brake control wire 77. The height of upper support members 16 and 17 is adjusted by loosening respective knobs 78 and 79, repositioning sleeve portions 18 and 20, and tightening knobs 78 and 79.

Figure 2:
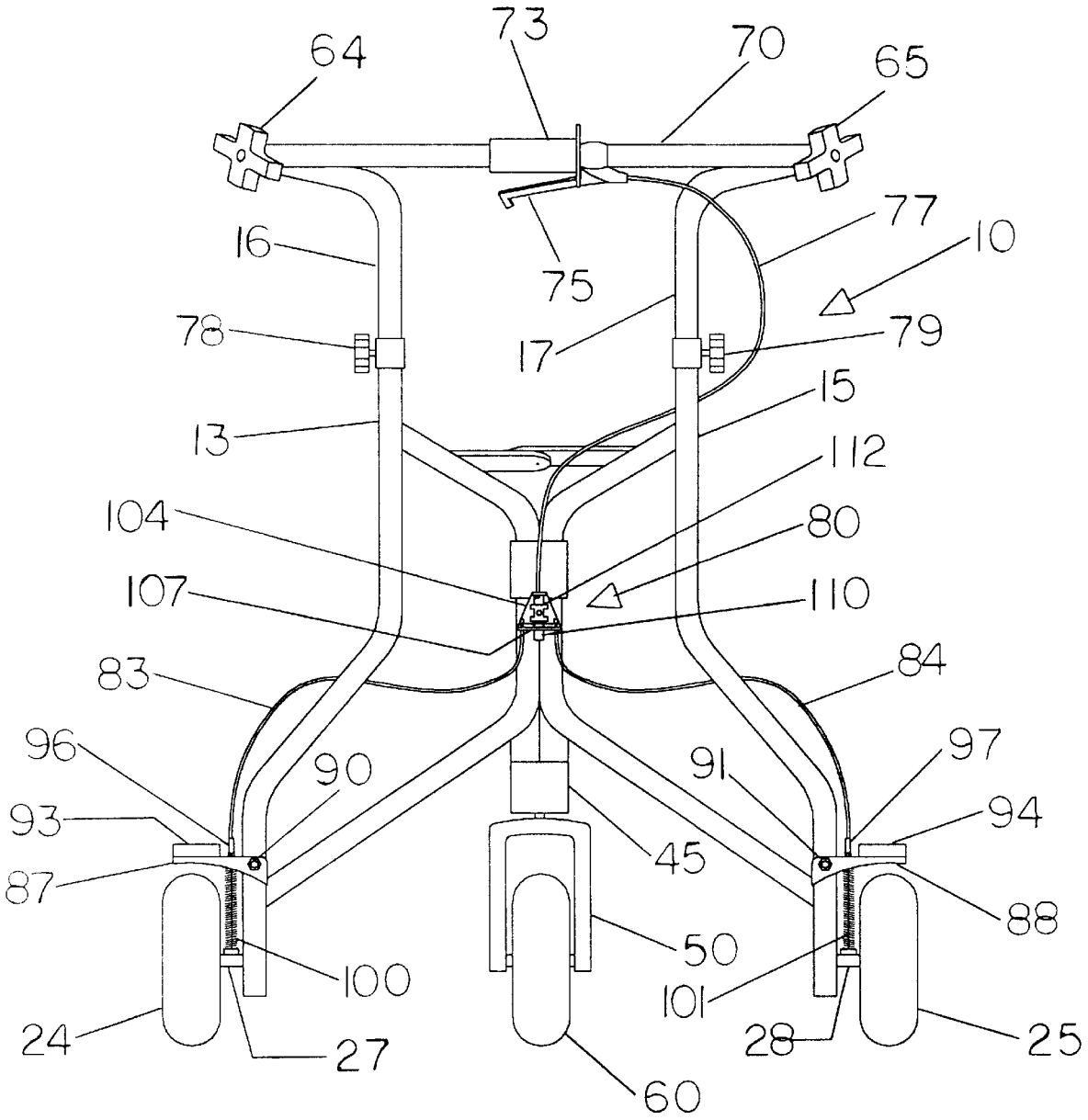
FIG. 2 is a rear elevation of the view of FIG. 1.

As seen in FIG. 2, control wire 77 is connected to a bifurcated fitting 80 from which brake wires 83 and 84 extend to and through a respective pair of brake pads 87 and 88. Brake pads 87 and 88 pivot about a respective pair of shafts 90 and 91, are provided with a respective pair of foot pads 93 and 94 and are cored to receive in a close fitting relationship brake wires 83 and 84 so that brake pads 93 and 94 may be pressed downward by a respective pair of collar fittings 96 and 97. A respective pair of springs 100 and 101 are inserted over the ends of wires 83 and 84 after which wires 83 and 84 are secured to respective axles 27 and 28 in a conventional manner, not shown. Bifurcated fitting 80 consists essentially of a chamber 104 having an opening in the upper surface thereof for receiving control wire 77 and a flange 107 at the lower end thereof that is cored to receive in close fitting relationship a rod portion 110 of a force transfer member 112 which is secured in conventional manner to the end of control wire 77. Bifurcated fitting 80 is removably secured in conventional manner to joined members 38 and 39 preferably below collar 42, while members 34 and 35 are interconnected by a respective pair of links 114 and 115 which are secured by respective bolts 118 and 119 to members 34 and 35 and in lockable relationship to one another by a common bolt 121.

In operation, with cross bar 70 secured to the walker by winged bolts 64 and 65, initial pressure on brake handle 75 operates to force transfer member 112 downward into contact with flange 107 while additional pressure on handle 75 forces flange 107, brake wires 83 and 84 and brake pads 87 and 88 downward causing the brake pads to exert a braking force on wheels 24 and 25. Walker 10 may be easily folded by removing at least one end of crossbar 70 and unlocking the pair of links 114 and 115 which are secured by bolts 118, 119 and 121.

It will be appreciated that although this invention has been made for use by persons who have the use of only one arm, it is applicable to others not so limited since, among other reasons, a person could maintain stability using one arm and leaving the other arm free to shop, use the free hand to lead a child or another person, or pick up articles or objects on a floor or on the ground. Crossbar 70 can also be installed on standard walkers having two handles by removing the handles, placing a crossbar between the two handle bars, and installing a single brake handle centrally in the crossbar.

Although this invention has been disclosed and described with reference to a preferred embodiment, its principles are susceptible to other applications which will be apparent to persons skilled in the art. Thus, many modifications, additions, and deletions may be made to the invention without departure from the scope of the invention as set forth in the following claims.

What is claimed is:

1. A walker adapted for use by persons limited to the use of one arm, said walker comprising:

a lower section having a pair of similarly formed lower support members, and an upper section having a pair of upper support members, said upper support members having sleeve portions slidably received in said lower support members, said lower support members each having a tightening knob for repositioning said upper and lower support members in lockable relationship therewith, said pair of lower support members being connected by a respective pair of links in lockable relationship to each other, three transport wheels mounted on said lower support members;

a braking means having a bifurcated fitting connecting a dual wire lower portion and a single wire upper portion, means connecting the lower portion of said braking means to the two rearmost ones of said wheels, a removable crossbar interconnecting the ends of said upper support members;

a handle mounted in said crossbar and a single wire connecting the upper portion of said braking means to said handle and connecting to said lower portion at said bifurcated fitting for actuation of said braking means, whereby a person may, by use of one arm, control the operation and braking of said walker.

2. The walker as defined in claim 1 and further including left and right braking pads in said lower portion braking means, said braking pads pivotally mounted on respective ones of said lower support members, said braking pads movable downward upon actuation of said handle, whereby said walker is braked by a downward force applied on the wheels thereof through said braking pads.

3. The walker as defined in claim 2 wherein the respective ends of said lower support members extend through said braking pads and terminate at the axles of each wheel;

a stop secured on the lower ends of said lower support members to prevent the respective braking pads from extending too far above said wheels upon actuation of said handle; and a spring enclosing the respective ends of said lower support members between said respective pads and wheel axles, whereby upon release of said handle said pads will be elevated above said wheels by said springs.

4. The walker as defined in claim 3 and further including a foot pad on each of said braking pads, whereby a person using said walker may selectively brake one of the wheels of said walker.

5. The walker as defined in claim 4 wherein the lower portion of said braking means is a bifurcated connector; and means securing said connector to said lower section.

6. The walker as defined in claim 5 and further including a collar confining said lower support members adjacent a third wheel of said walker, whereby said walker may be collapsed upon disconnection of at least one end of said crossbar.

7. A three-wheeled walker having a forward wheel rotatably mounted to a forward wheel support and a pair of laterally spaced apart rear wheels rotatably mounted to respective ones of a pair of rear leg supports comprising:

a braking means associated with each of said rear wheels;

a brake control means centrally mounted above said rear wheels, said braking control means operable by a single brake handle; and a bifurcated means for relaying braking control from said brake to said braking means at each of said rear wheels.

* * * * *